United States Patent [19]

Marx, Jr.

[11] Patent Number: 4,999,086

[45] Date of Patent: Mar. 12, 1991

[54] DISPERSION ROLL IN A FOURDRINIER MACHINE

[76] Inventor: Edmund N. Marx, Jr., 102 E. Weed St., St. Marys, Ga. 31558

[21] Appl. No.: 533,941

[22] Filed: Jun. 4, 1990

Related U.S. Application Data

[63] Continuation of Ser. No. 390,462, Aug. 4, 1989, abandoned, which is a continuation of Ser. No. 218,969, Jul. 14, 1988, abandoned, which is a continuation-in-part of Ser. No. 158,942, Feb. 22, 1988, abandoned.

[51] Int. Cl.[5] ..... D21F 1/20

[52] U.S. Cl. ..... 162/209; 162/211; 162/351; 162/355; 162/356

[58] Field of Search ..... 162/208, 209, 211, 308, 162/314, 351, 354, 355, 356; 29/121.1–121.3, 121.5, 121.6

[56] References Cited

U.S. PATENT DOCUMENTS

| | | | |
|---|---|---|---|
| 1,839,158 | 12/1931 | McDonnell | 162/209 |
| 2,092,798 | 9/1937 | Charlton | 162/356 |
| 2,095,378 | 10/1937 | Charlton | 162/356 |
| 2,369,653 | 2/1945 | Berry et al. | 162/DIG. 7 |
| 2,694,345 | 11/1954 | Hornbostel | 162/DIG. 7 |
| 3,549,487 | 12/1970 | Clark | 162/356 |
| 3,960,653 | 6/1976 | Futcher et al. | 162/DIG. 7 |
| 4,306,934 | 12/1981 | Sepparen | 162/209 |

FOREIGN PATENT DOCUMENTS

| | | | |
|---|---|---|---|
| 187711 | 7/1907 | Fed. Rep. of Germany | 162/356 |
| 1611761 | 1/1971 | Fed. Rep. of Germany . | |

*Primary Examiner*—Karen M. Hastings
*Attorney, Agent, or Firm*—Arthur G. Yeager

[57] ABSTRACT

In a Fourdrinier paper making machine a dispersion roll mounted between the headbox and the suction and dewatering means, underneath in contact with the Fourdrinier travelling fabric and extending laterally across the width of the fabric, and adapted to rotate at about the same speed as that of the fabric; the roll having a fluted surface of alternating lands and grooves, and a plurality of spaced, parallel, lateral slots across each said land to communicate each groove with the next adjacent groove. The function of the roll is to vibrate the travelling fabric and cause better dispersion of the paper fibers.

26 Claims, 2 Drawing Sheets

DISPERSION ROLL IN A FOURDRINIER MACHINE

This is a continuation of copending application(s) Ser. No. 07/390,462 filed on Aug. 4, 1989, now abandoned, which is a continuation of application 07/281,969 filed on July 14, 1988, now abandoned, which is a c-ip of pending U.S. patent application Ser. No. 158,942, filed Feb. 22, 1988, now abandoned.

BACKGROUND OF THE INVENTION

The Fourdrinier paper making process and machine involves a travelling screen or fabric onto which is fed an aqueous dispersion of cellulosic fibers. The screen is moved over suction and dewatering devices to pull water through the screen and leave the fibers on the top of the screen to form a thin wet web of fibers that is peeled from the screen and transferred to a travelling felt which conducts the wet web through press rolls and a finishing section involving steam heated drying cans and calender rolls to produce a continuous sheet of paper. Such a machine and process tends to orient most of the fibers in the direction of movement of the travelling screen or fabric, and this produces a paper which is strong in the direction of oriented fibers and weak in the normal direction. While such unbalanced strengths may be acceptable in some application, e.g., newsprint, it is not acceptable for other uses, e.g., wrapping paper, bag production, etc.

Attempts have been made to solve this problem by shaking the travelling fabric or by using fluted suction box rolls that are operated at some speed other than that of the travelling fabric. See, for example, U.S. Pat. No. 2,092,798 to Charlton; U.S. Pat. No. 2,095,378 to Charlton; and U.S. Pat. No. 4,306,934 to Seppanen. None of these solutions has been completely successful, and the fibers continue to exhibit too much orientation to provide a desirable strength in all directions.

In German Offenlegungsschrift 1,611,761 published Jan. 28, 1971, there is a disclosure that, at first glance, appears to be closely related to the present invention in that the patentee uses grooved rolls in a Fourdrinier paper making machine immediately downstream from the headbox where the fibers are being formed into a wet sheet. The manner in which the grooved rolls of this prior art patent are used and their purpose are greatly different than is the case with the rolls of this invention. The patent teaches the use of very small grooves and spacings between grooves to produce increased drainage of water through the Fourdrinier screen when the rolls are driven oppositely to the screen. This invention uses considerably larger (3-6 times larger) grooves and spacings to impede the drainage while the rolls are turned at substantially the same speed and in the same direction as the movement of the Fourdrinier screen.

It is an object of this invention to provide a novel paper making process and dispersion roll for use in that process. It is still another object to provide a roll that shows remarkable improvement in maintaining a random orientation of fibers in a paper making dispersion just prior to web formation. Still other objects will appear from the more detailed description which follows.

BRIEF SUMMARY OF THE INVENTION

This invention relates to a Fourdrinier paper machine having a headbox, a forming board, and a travelling sheet forming fabric, wherein the improvement is a sheet forming roll having a longitudinal axis and mounted transverse to the direction of fabric movement and underneath and contiguous to said fabric, adjacently downstream from said forming board, said roll being adapted to turn at substantially the same circumferential speed and direction as the linear speed and direction of the said fabric; said roll including an elongated substantially cylindrical shape with a fluted outer surface of alternating lands and grooves, generally parallel to said longitudinal axis of said roll, said lands having a generally rectangular transverse cross section and having a plurality of spaced transverse slots between adjacent said grooves.

In specific embodiments the sheet forming roll has a fluted surface of trapezoidal lands separated by V-shaped grooves, with the lands having a plurality of spaced parallel, thin, lateral slots communicating each groove with the next adjacent groove. In one specific embodiment the grooves terminate at each end before reaching the end of the roll.

The invention also provides a Fourdrinier process for making paper on a travelling fabric having upper and lower surfaces including a headbox for introducing an aqueous dispersion of fibers onto said fabric, a forming board to spread the dispersion into a uniform thin layer on the fabric, suction and dewatering means for removing water from said dispersion to leave a fibrous web on said fabric, and means to remove said web from said fabric and dry and finish said web to produce paper, the improvement which comprises positioning between said forming board and said suction and dewatering means at least one elongated roll, in the absence of any cooperating suction box, adapted to vibrate said fabric in a direction normal to said surfaces of said fabric, said roll having a length substantially equal to the width of said fabric and being mounted underneath and in contact with said lower surface of said fabric with the longitudinal axis of said roll perpendicular to the direction of travel of said fabric, said roll having a fluted outer surface of lands and grooves generally parallel to said longitudinal axis, said roll rotating at substantially the same peripheral speed as the linear speed of said fabric and producing vibrations having a magnitude of about 0.1-1.0mm normal to the surface of the roll to occur upon contact of said lands with said lower surface of said fabric which tend to agitate said fibers in dispersion and enhance the random orientation of said fibers whereby the finished paper has more desirable sheet strength properties in all directions.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
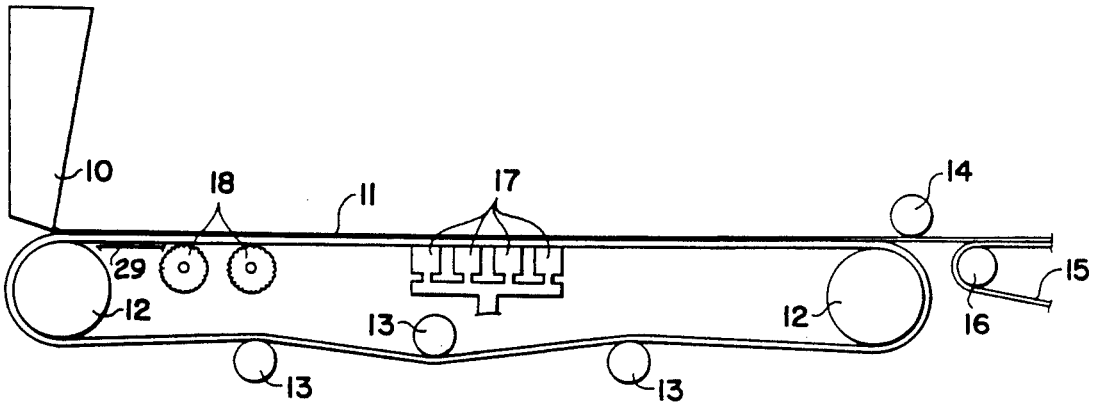
FIG. 1 is a schematic diagram of a Fourdrinier paper making process using the rolls of this invention.
Figure 2:
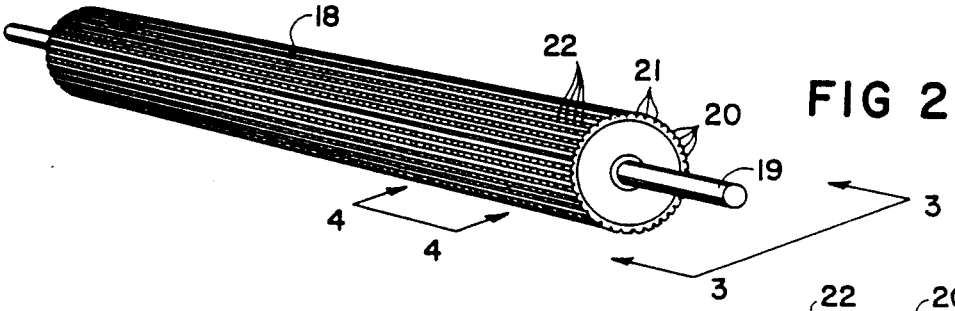
FIG. 2 is a perspective illustration of one embodiment of the roll of this invention.

FIG. 1 is a schematic illustration of a Fourdrinier paper making process and machine employing the rolls of this invention. Headbox 10 contains an aqueous slurry or dispersion of cellulosic fibers used to make paper. A travelling fabric, ("sometimes referred to as a 'wire' or a 'screen'") runs clockwise around rolls 12 and through tensioning idler rolls 13 passing under the outlet of headbox 10. A thin sheet of the aqueous dispersion of fibers is distributed from headbox 10 uniformly across the entire width (e.g., 12–35 feet) of fabric 11 and passed on to forming board 29. The water in the dispersion drains through fabric 11 to leave a wet fibrous web which eventually becomes sufficiently selfsupporting to be stripped away from fabric 11 at lump breaker roll 14 and conducted away on travelling felt 15 driven by roll 16. The wet web on felt 15 is then pressed, dried, and calendered (not shown) to a smooth paper sheet.

In the portion of the process immediately downstream from headbox 10 and forming board 29 the aqueous dispersion must be maintained uniform across fabric 11 and dewatered as quickly as possible. Normally there are employed suction boxes 17 of some kind that remove water by vacuum. In order to produce a quality product there must be some means to keep the fibers in the dispersion in a truly dispersed condition, oriented in random directions, and uniformly spread throughout the aqueous layer on fabric 11. If those fibers are allowed to settle or to assume whatever orientation they will take without outside influences, the distribution of fibers will not be uniform and most of the fibers will be oriented in the direction of movement of the travelling fabric. The result is a paper with nonuniform strength, i.e., areas of high strength in one direction (i.e., the direction of travel of the fabric) and poor strength in the normal direction (i.e., perpendicular to the direction of travel of the fabric). Accordingly, it is the purpose of rolls 18 of this invention to eliminate those nonuniformities to the maximum extent possible.

The details and features of one embodiment of the dispersion rolls 18 of this invention are shown in FIGS. 2–6. One or more, preferably two, of such rolls 18 are employed between the forming board 29 and the suction and dewatering means 17. Each roll 18 is positioned laterally across fabric 11, underneath and in contact with the lower surface of fabric 11. Rolls 18 are rotated at substantially the same speed as that of travelling fabric 11. Normally, rolls 18 are rotated by the forces of fabric 11 being moved across and in contact with the outer surfaces of rolls 18. It is operable, but not preferred, for rolls 18 to be rotated by a driving force separate from fabric 11.

Rolls 18 are elongated cylindrical rolls having an outer surface which is fluted with alternating lands 20 and grooves 21 which are oriented substantially parallel to the longitudinal axis of roll 18, the center line of shaft 19. Substantially perpendicular to lands 20 and grooves 21 are a plurality of spaced, parallel, thin slots 22 through each of the lands 20 to provide a fluid passageway between adjacent grooves 21. Some of the water from the aqueous dispersion on fabric 11 drains automatically through fabric 11 to rolls 18 and collects in grooves 21, from which water drains to either or both of the ends of grooves 21 at the lateral edges of fabric 11. That water is removed from grooves 21 and is recycled to produce more aqueous dispersion for headbox 10. A substantial portion of the water in the dispersion, however, is pulsed upwards by the rotation of roll 18 returning water to the dispersion and agitating the fibers to produce a more uniform dispersion of randomly oriented fibers. This action delays the drainage and causes more water to be removed by the suction and dewatering means downstream of rolls 18.

Figure 3:
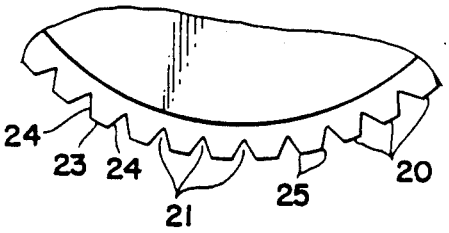
FIG. 3 is an enlarged partial end elevational view of the roll taken in the direction of 3—3 of FIG. 2.
Figure 5:
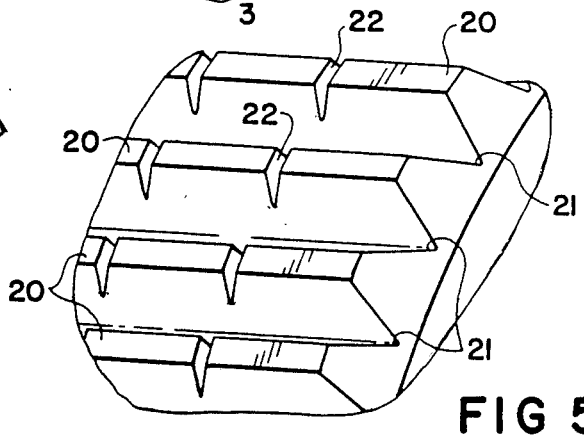
FIG. 5 is an enlarged perspective view of a portion of the surface of the roll of this invention.
Figure 4:
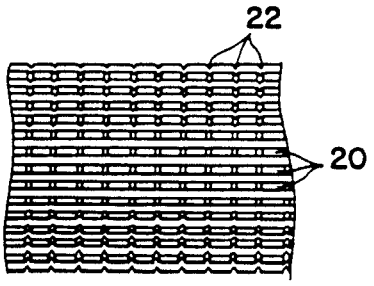
FIG. 4 is an enlarged partial side elevational view of the roll taken in the direction of 4—4 of FIG. 2.
Figure 6:
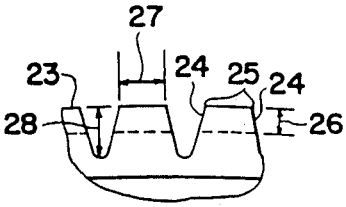
FIG. 6 is an enlarged end elevational view of some of the lands and grooves of the roll of this invention.

The fluted surface of roll 18 is a plurality of alternating lands 20 and grooves 21. The general cross sectional shape of lands 20 (as seen in FIGS. 3, 5 and 6) is rectangular, preferably trapezoidal with an upper flat surface 24 diverging outwardly from the ends of surface 23 to form a V-shaped groove 21 with a corresponding sloping side surface 24 from the next adjacent land 20. Corners 25 formed by the intersection of outer surface 23 and side surface 24 are reasonably sharp, i.e., as sharp as possible without causing undue wear of fabric 11. Usually this sharpness is the result of smoothing any ragged edges, but not chamfering or rounding those edges.

Slots 22 provide a fluid communication between adjacent grooves 21 to permit water to flow from one groove 21 to another groove 21. This helps to prevent any localized pressure differentials in the several grooves 21, and to slow down water drainage. Slots 22 are thin, generally parallel to each other, spaced generally uniformly from one end of each land 20 to the other end thereof. Preferably the slots are oriented in a direction substantially perpendicular to the longitudinal axis of the roll 18.

As a general rule there will be 3–5 lands per inch of outside diameter of roll 18 and the depth 28 of grooves 21 will vary from 1–5% of the outside diameter of roll 18. In normal sizes of Fourdrinier machines having widths of fabric 11 from about 230 inches to about 400 inches, rolls 18 should be about 12–24 inches in outside diameter, greater fabric widths coordinating with larger roll diameters to provide maximum strength to oppose deflection of the roll. Each roll has about 40–120 lands 20 and 40–120 grooves 21, with each land measuring about 0.1875 to 0.375 inch across its top surface 27, adjacent lands having a center-to-center distance of about 0.625 to 0.85 inch; and grooves 21 being about 0.40 to 0.75 inch deep. Slots 22 are about $\frac{1}{3}$ to 1/2 of the depth of grooves 21, about 0.10 to 0.125 inch wide, and spaced apart about 0.5 to 1.0 inch, measured lengthwise of the roll.

The action produced by rolls 18 is a vertical (i.e., normal or perpendicular to the surfaces of fabric 11) vibration of fabric 11 which causes the water in the dispersion not to drain quickly through fabric 11, and causes the dispersed fibers to remain dispersed and not settle to the bottom too quickly nor become oriented in the direction of travel of fabric 11. The vibration stroke is very small, e.g., 0.1 to 1.0 mm, which is intended to approximate the distances between adjacent fibers in the dispersion, and the frequency, which varies with the speed of the machine will normally be from about 500 to about 2,000 strokes per second, increasing with increases in linear speed of travel of fabric 11. In the past, it was a common practice to provide the Fourdrinier screen 11 with a horizontal vibration having a frequency of about 4–5 cycles per second at screen speeds of up to 200 feet/min. to produce an excellent quality of paper. As machine speeds increased over the recent years the horizontal vibration technique has not been able to maintain the quality dispersion of fibers desired by the industry. The vertical vibrations produced in the present process are the first successful attempts to reproduce the desired quality of dispersion of the old 4–5 cycle horizontal vibration.

There is no suction produced by rolls 18; the rotation of rolls 18 actually produces the opposite result in that it slows down the dewatering. Nevertheless, there is some amount of dewatering by drainage onto rolls 18. The principal water removal takes place in suction and dewatering means downstream of rolls 18, such as 17 in FIG. 1, to accelerate the web formation and thereby shorten the length of travel from headbox 10 to lump breaker roll 14.

Rolls 18 may be made of metal, plastic, rubber, fiberglass reinforced resin, or the like. Normally an outer shell is applied to a previously used roll and the lands 20, grooves 21, and slots 22 are machined therein.

Figure 7:
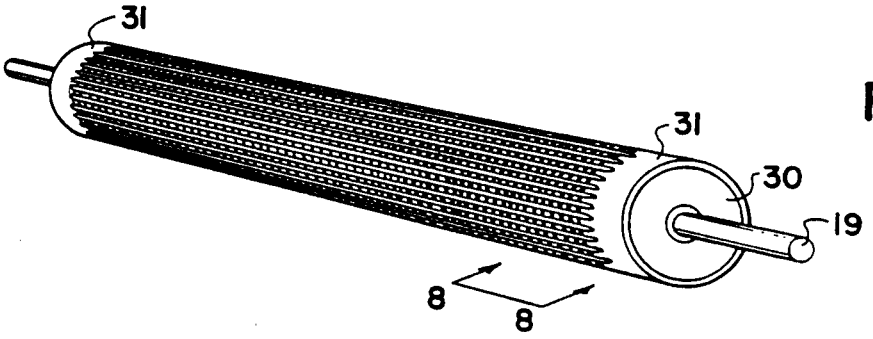
FIG. 7 is a perspective illustration of a second embodiment of the roll of this invention.
Figure 8:
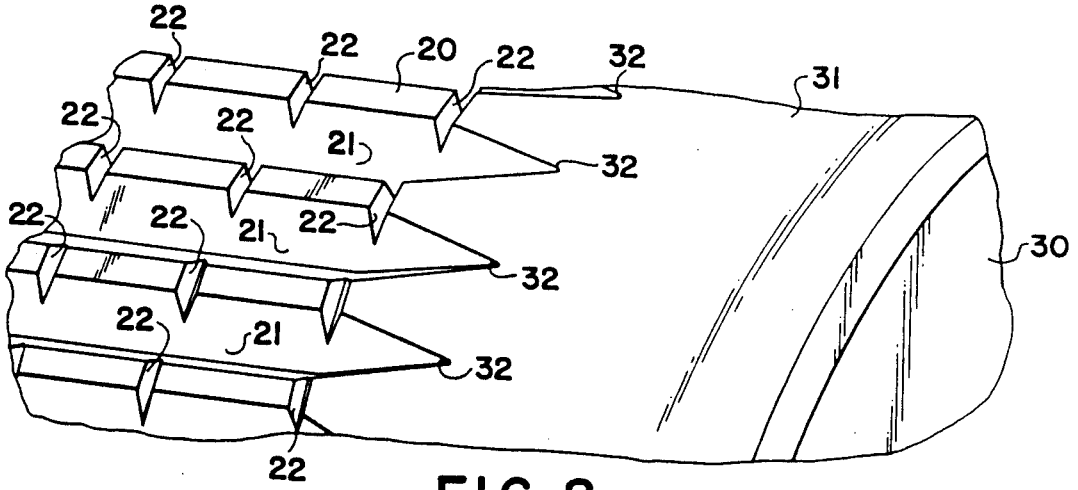
FIG. 8 is an enlarged perspective view of a portion of the surface of the roll as at 8—8 of FIG. 7.

At the high speeds of modern paper-making machinery (1500–2000 feet/min.) the water and fiber which drains through fabric screen 11 to rolls 18 into grooves 21 is thrown out from the ends of rolls 18 and thrown forward from the ends of the roll as it turns beyond its contact with the underside of fabric screen 11. Not only does this cause a loss of water and fabric, but it produces a watery mess that must eventually be cleaned up. In order to meet this problem two revisions in the machinery have been developed. In FIGS. 7 and 8 is one revision to terminate grooves 21 by bringing them to ends 32 by tapering the bottom of groove 21 upwardly until it merges with the outside surface defining lands 20. The result is a smooth portion 31 at each end 30 of roll 18. The linear distance (measured parallel to the rotating axis of roll 18) along surface 31 from a groove end 32 to the end 30 of the roll is about 3–5 inches or about 13–35% of the diameter of roll 18. This type of revision prevents water and fiber from being thrown laterally out the end of roll 18 because the screen 11 covers the entire groove from one end 32 to the other end 32 of the same groove.

Figure 9:
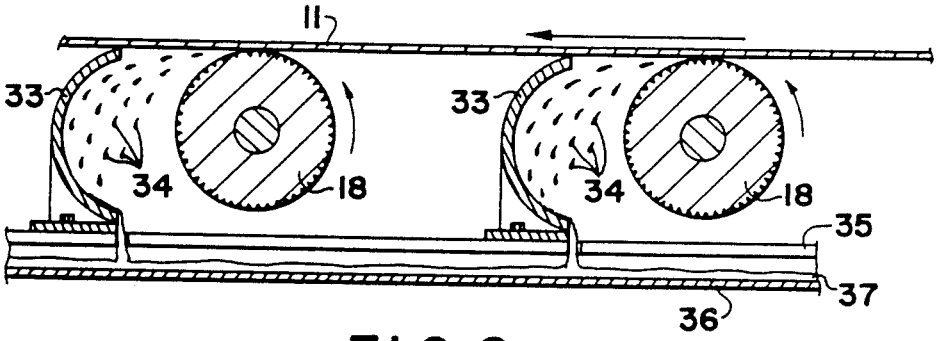
FIG. 9 is a cross-sectional view taken at 9—9 of FIG. 10.
Figure 10:
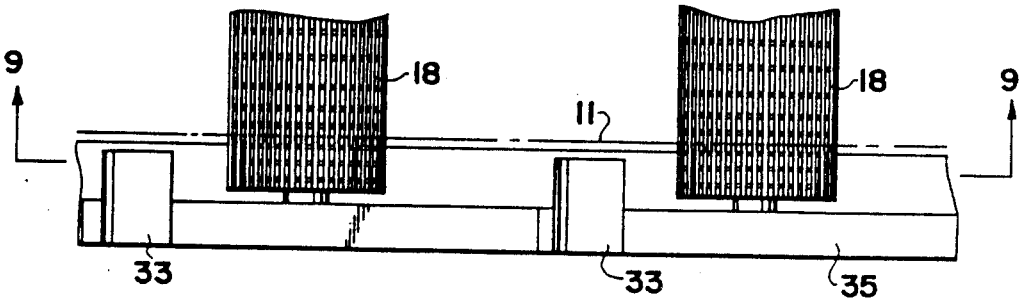
FIG. 10 is an enlarged partial top plan view of the paper making machinery employing the roll of FIG. 2.

A second improvement is shown in FIGS. 9 and 10 wherein shields 33 are placed adjacent to and a short space downstream from roll 18 underneath screen 11. Shields 33 are generally semi-cylindrical and positioned to catch the splashed water thrown from the ends of roll 18. The water and fiber drains into a gutter 36 attached to machine frame 35 and runs off, as at 37, to a means for recycling the water and fiber back to headbox 10. Shields 33 are especially useful with rolls 18 of the type shown in FIG. 2 where grooves 21 continue to the end 30 of the roll. However, it may be desirable in some instances to use such shields 33 with rolls 18 of the type shown in FIGS. 7–8 having grooves 21 that terminate before reaching the roll end 30.

One of the principal advantages of the present machine and process is that the initial drainage of water is slowed down permitting the deposition of fines and short fibers throughout the paper sheet, resulting in a sheet that has much better release properties than that from machines not using the rolls of this invention. The advantages of good sheet release properties are well known, including less breaks and tears, better sheet consistency, ability to go to higher speeds, etc.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the U.S. is:

1. In a Fourdrinier paper machine having a headbox, a forming board and a travelling sheet forming fabric onto which an aqueous dispersion of fibers is deposited, the improvement comprising an elongated sheet forming roll having opposite end portions, a longitudinal axis passing through said end portions and being mounted transverse to the direction of fabric movement and underneath and contiguous to said fabric adjacently downstream from said forming board, said roll being rotated about said longitudinal axis at substantially the same circumferential speed and direction as the linear speed and direction of the said fabric; said roll including an elongated substantially cylindrical shape with a fluted outer surface of alternating lands and grooves generally parallel to said longitudinal axis of said roll, said lands having a generally trapezoidal transverse cross section with a narrowed flat top surface joined at each edge and diverging outwardly away from each said edge, said lands having a plurality of spaced slots formed between adjacent said grooves generally perpendicular to said longitudinal axis with the bottom of said slots being spaced above the bottoms of said grooves, said slots having a depth of about $\frac{1}{3}$ to $\frac{1}{2}$ of the radial depth of said grooves , said slots being structured to provide free liquid flow between adjacent said grooves, said narrowed flat top surfaces of said lands engaging said fabric by rotation of said roll and inducing minute vertical vibrations of said fabric to agitate the fibers and enhance the random orientation thereof and minimizing dewatering adjacent said forming board and said roll.

2. In the machine of claim 1 wherein said narrowed top surface and said sloping sides for two longitudinal parallel corners parallel to said longitudinal axis, each said corner being substantially sharp and smooth to inhibit wear of said fabric by said rotating roll.

3. In the machine of claim 1 wherein said spaced slots of substantially all of said lands are located in a plurality of spaced transverse and parallel planes perpendicular to said longitudinal axis.

4. In the machine of claim 1 wherein each said groove extends throughout the length of said roll and has opposite and open ends substantially at respective side edges of said fabric.

5. In the machine of claim 4 additionally comprising a generally semicylindrical shield mounted adjacent each end portion of said roll and spaced adjacently downstream of said roll in the direction of travel of said sheet forming fabric, each said shield being adapted to catch water and fibers splashing off said end portions of said roll, and means to collect the water and fibers from said shield and recycle same to said headbox.

6. In the machine of claim 1 further comprising a suction and dewatering means for removing water from an aqueous dispersion of fibers onto said fabric, said suction and dewatering means being located spacedly downstream from said roll, said roll being operable to inhibit dewatering of the aqueous dispersion of fibers on said fabric adjacent said forming board and said roll due to the induced minute vertical vibrations of said fabric by said roll.

7. In the machine of claim 1 further comprising another roll substantially identical to said roll and located adjacent said roll, said roll and said another roll each producing minute vertical vibrations on said fabric as said rolls rotate and said fabric moves in said direction whereby dewatering is further minimized adjacent to said forming board and said rolls.

8. In the machine of claim 1 wherein each said grooves terminate approximately 3–5 inches from each lateral free end of said roll.

9. In the machine of claim 1 wherein each of said roll end portions has a non-fluted outer surface substantially coplanar with said narrowed flat top surfaces of said lands.

10. In the machine of claim 1 wherein the radial distance from said narrowed top surfaces of said lands to respective said bottoms of said grooves are about 1–5% of the outside diameter of said roll, the number of said lands being about 3–5 per inch of said outside diameter of said roll, and the number of said grooves being about 3–5 per inch of said outside diameter of said roll.

11. In the machine of claim 10 wherein said spaced slots are generally parallel beneath said fabric between said end portions of said roll and are V-shaped as viewed in said direction of fabric movement.

12. In the machine of claim 10 wherein each said slot of each said adjacent lands are in circular planar alignment about said roll.

13. In a Fourdrinier paper machine having a headbox, a forming board and a travelling sheet forming fabric onto which an aqueous dispersion of fibers is deposited, an elongated sheet forming roll having opposite ends and a longitudinal axis between said ends and being mounted transverse to the direction of fabric movement and underneath and contiguous to said fabric, adjacently downstream from said forming board, said roll including an elongated substantially cylindrical shape with a fluted outer surface of alternating lands and grooves generally parallel to said longitudinal axis of said roll, said roll being adapted to rotate and induce minute vertical vibrations to said fabric to agitate the fibers and enhance the random orientation thereof, said lands having a generally rectangular transverse cross section, each said groove having opposite ends, the improvement wherein each end of each said groove tapers diametrically outwardly and disappears by merging into said outer surface at a location adjacently inward of respective said end of said roll.

14. In the machine of claim 13 further comprising a plurality of spaced slots formed between and generally perpendicular to said grooves.

15. In the machine of claim 13 wherein each said grooves terminate approximately 3–5 inches from each lateral free end of said roll.

16. In the machine of claim 13 wherein said lands are trapezoidal with a narrowed flat top surface joined at each edge and diverging outwardly away from each said edge.

17. In the machine of claim 16 wherein said narrowed top surface and said sloping sides form two longitudinal parallel corners parallel to said longitudinal axis, each said corner being substantially sharp and smooth to inhibit wear of said fabric by said rotating roll.

18. In the machine of claim 17 wherein the radial distance from said narrowed top surfaces of said lands to respective said bottoms of said grooves are about 1–5% of the outside diameter of said roll, the number of said lands being about 3–5 per inch of said outside diameter of said roll, and the number of said grooves being about 3–5 per inch of said outside diameter of said roll.

19. In the machine of claim 13 wherein said roll adjacent respective said end being a smooth and nonfluted portion having an outer surface substantially coextensive with said lands.

20. In the machine of claim 19 wherein each said smooth and nonfluted portion extends an axial distance of about 13–35% of the outside diameter of said roll.

21. In a Fourdrinier process for making paper on a travelling fabric having upper and lower surfaces including a headbox for introducing an aqueous dispersion of fibers onto said fabric, a forming board on which said dispersion spreads out to form a thin uniform layer of said dispersion, suction and dewatering means for removing water from said dispersion to leave a fibrous web on said fabric, and means to remove said web from said fabric and dry said web, at least one elongated roll positioned between said forming board and said suction and dewatering means and in the absence of any cooperating suction box or the like, said roll vibrating said fabric in a direction normal to said surfaces of said fabric, said roll having a length substantially equal to the width of said fabric and being mounted underneath and in contact with said lower surface of said fabric with the longitudinal axis of said roll being perpendicular to the direction of travel of said fabric, said roll having a fluted outer surface of alternating lands and grooves generally parallel to said longitudinal axis, the improvement which comprises spaced end portions of said roll each having for an axial distance of about 13–35% of the outside diameter of said roll a smooth outer surfacesubstantially coextensive with said lands whereby dewatering through said fabric at said end portions is substantially prevented, said roll rotating and producing vibrations having a magnitude of about 0.1–1.0 mm normal to the surface of said roll to occur upon contact of said lands and said end portions with said lower surface of said fabric which tend to agitate said fibers in dispersion and enhance the random orientation of said fibers whereby the paper being produced has more uniform and desirable sheet strength properties in all directions.

22. The process of claim 21 wherein said roll is rotated by the forces produced in pulling said fabric across said lands and said end portions of said roll.

23. The process of claim 22 wherein said forces are produced solely by contact of said roll with said fabric.

24. The process of claim 21 wherein said lands have a lateral cross section which is trapezoidal with a narrowed flat outer surface joined at each edge thereof to a diverging sloping side surface, said side surfaces forming a V-shaped groove between adjacent said lands.

25. The process of claim 24 wherein said outer surface of each said land contains a plurality of spaced lateral narrow slots communicating between adjacent said grooves, and being generally perpendicular to the rotational axis of said roll.

26. The process of claim 25 wherein said slots have a depth of about $\frac{1}{3}$ to $\frac{1}{2}$ of the radial depth of said grooves.

* * * * *